United States Patent [19]

Stojanowski

[11] 4,433,658

[45] Feb. 28, 1984

[54] BI-ANNULUS ROTARY ENGINE

[76] Inventor: John S. Stojanowski, 198 Heberton Ave., Staten Island, N.Y. 10302

[21] Appl. No.: 460,593

[22] Filed: Mar. 16, 1983

Related U.S. Application Data

[63] Continuation-in-part of Ser. No. 246,101, Mar. 20, 1981, abandoned.

[51] Int. Cl.[3] ..... F02B 53/00

[52] U.S. Cl. ..... 123/221; 418/4

[58] Field of Search ..... 123/230, 200, 241, 221; 418/4, 207, 270

[56] References Cited

U.S. PATENT DOCUMENTS 2,661,727 12/1953 Cousin ..... 123/221

*Primary Examiner*—Michael Koczo

[57] ABSTRACT

An internal combustion engine is disclosed having valve means, ignition means, timing means and fuel distribution means configured for operation on a combustible mixture of fuel and air or other energy source. A rotor, consisting of loosely coupled rectangular segments, traverses a 'figure 8' path within a rotor housing consisting of two overlapping hollow annuluses. The rotor, when contained in one of the annuluses, fully circumscribes that annulus. Traversal of one of the annuluses by the rotor results in intake of a fuel/air mixture, compression, ignition, power and exhaust cycles in successive revolutions. Traversal of the second annulus by the rotor transfers the orbital rotation of the rotor to a concentrically disposed power transfer shaft.

6 Claims, 7 Drawing Figures

BI-ANNULUS ROTARY ENGINE

BACKGROUND OF THE INVENTION

This invention relates to rotary engines of the internal combustion type. The invention is characterized by a novel, simplistic, efficient and compact design.

Rotary engines, in general, provide maximum torque for a much longer part of their operating cycle than their reciprocating counterparts. In view of the ever increasing consciousness of energy efficient devices, rotary engines are being given much more attention today than in the past.

Prior art rotary combustion engines generally contain an irregularly shaped rotor enclosed within a mating housing. This irregular shape causes excessive unsymmetrical loading and wear at a few points and contributes to a rapid loss of efficiency. Additionally, they generally contain many movable components such as vanes, reciprocating sealing mechanisms, etc., which are susceptible to malfunctioning and also make the manufacture of the engines very costly.

This invention does not incorporate the above undesirable characteristics which are common to prior art rotary engines.

DETAILED DESCRIPTION OF PREFERRED EMBODIMENTS

Figure 1:
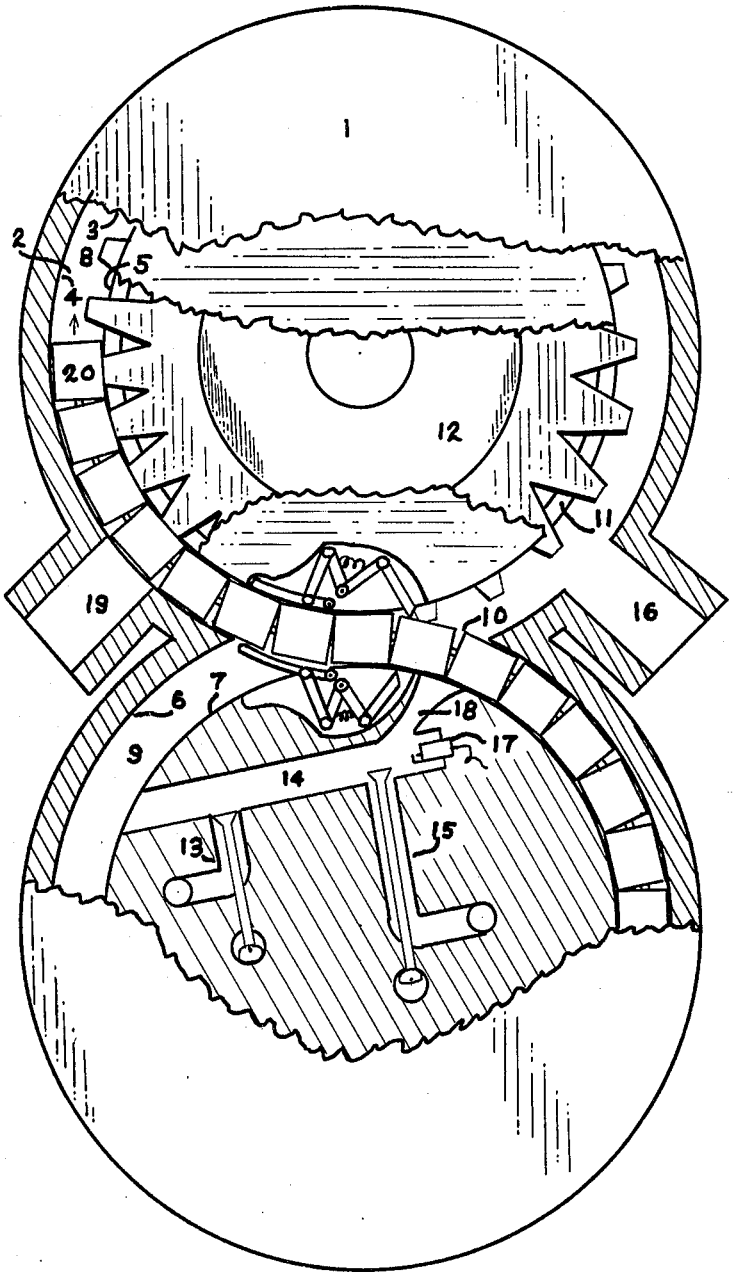
FIG. 1 is a schematic, fragmentary view of an encased rotary engine embodying the features of the present invention.

Referring to FIG. 1, the engine of the present invention includes a cylinder housing 1 which encloses the operative elements of the engine. This housing includes a lower planar portion 2 and a parallel upper planar portion 3. Circular sidewalls 4/5 and 6/7 along with the lower and upper portions form the hollow annuluses 8 and 9. These annuluses will be referred to as the power transfer annulus and the non-power transfer annulus, respectively. They overlap to form a common chamber 10.

The interior sidewall 5 of the power transfer annulus 8 contains a circular slot 11 around its circumference. This slot extends completely through this sidewall and is wide enough to accomodate a rotatable, concentrically disposed power transfer means 12 (e.g., a gear).

An entry conduit means 19 provides non-combustion, atmospheric air entry to the power transfer annulus and is in spaced relationship with the common chamber 10.

An exit conduit means 16 for withdrawing compressible, non-combustion air from the power transfer annulus is in spaced relationship with the common chamber 10.

The non-power transfer annulus 9 contains a cylindrical compression/combustion chamber 14 recessed within its inner perimeter. This compression/combustion chamber is in spaced relationship with the common chamber 10 and contains fuel/air inlet means 15, exhaust means 13, ignition means 17 and a peripheral orifice 18 whereby a fuel/air mixture is compressibly forced from the non-power transfer annulus into the compression/combustion chamber.

The present invention is also amenable to a Diesel-type operation wherein air is admitted through the fuel/air inlet means 15 and fuel is admitted directly into the compression/combustion chamber 14 through a fuel injector (instead of the ignition means 17 shown).

Figure 2:
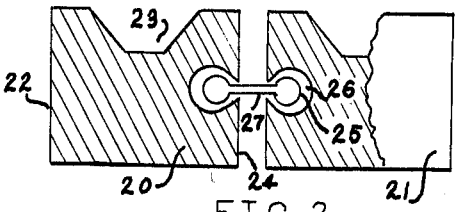
FIG. 2 is a fragmentary sectional view of the two leading segments of the rotor.

FIG. 2 is a detailed drawing of the leading two segments, 20 and 21 respectively, of the rotor. All of the rotor segments are the same size and contain one or more recessed cavities 23 along a common side of each rotor segment. The recessed cavities are in spaced relationship with the leading edge 22 and trailing edge 24 of each rotor segment. The recessed cavities are in cyclic communication and cooperation with the rotatable, concentrically disposed power transfer means 12. The leading and trailing edges of each rotor segment are parallel to each other and are parallel to a radial line, which bisects the rotor segment, drawn from the center of the annulus in which the rotor segment is positioned.

Each rotor segment is coupled to the adjacent rotor segment via a movable rod 27 capped at either end with a spherical member 25. The spherical member and a portion of the rod are recessed in a chamber 26 within each rotor segment. The dimensions of both the rod/spherical member and chamber are such that the rod/spherical member move in a lateral direction whereby the adjacent edges of adjacent rotor segments are always in sealable contact with each other.

Figure 3:
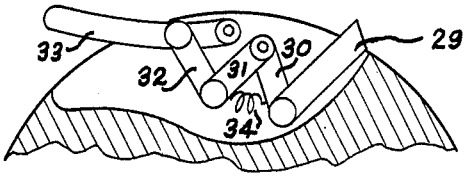
FIG. 3 is a fragmentary sectional view of the mechanism which guides the rotor to follow a 'figure 8' pattern within the engine.

FIG. 3 is a drawing of one of the rotor guide mechanisms used to guide the leading rotor segment from one annulus to the other, thereby insuring a 'figure 8' path of the rotor. There is a rotor guide mechanism located on either side of the common chamber 10. Guide arm 29 is depressed by the leading rotor segment 20 when the rotor approaches said common chamber. Rotor guide 33, being in communication with guide arm 29 via yieldable expansion spring 34 and pivot arms 30, 31 and 32, is forced to swing into the common chamber 10 causing the rotor to enter the opposite annulus.

It can be noted that although the accompanying drawings show annuluses which are rectangular in cross section and rotor segments which are rectangular hexahedrons (i.e., they are six sided and rectangular in cross section), the present invention will function in the same manner with these two elements using a plurality of shapes.

FIGS. 4–7 show the various positions of the rotor during a full operating cycle.

Figure 4:
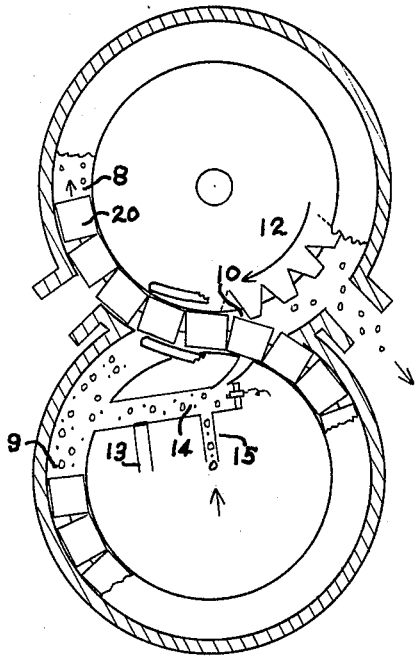
FIGS. 4–7 schematically illustrate the operative elements of the present invention during its operating cycle and include intake, compression, power and exhaust positions.

In FIG. 4 the fuel/air intake cycle has commenced. The leading rotor segment 20 has passed through the common chamber 10 where it has engaged the concentrically disposed, rotatable power transfer means 12 and is following a circular path in the power transfer annulus 8. Inlet conduit means 15 is open to admit a fuel/air mixture via induction means into the compression/combustion chamber 14 and the non-power transfer annulus 9. The exit conduit means 13 is closed.

Figure 5:
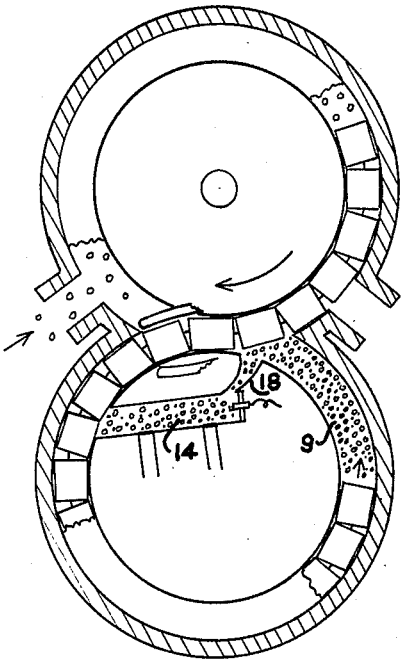

In FIG. 5 the compression of the fuel/air mixture in the non-power transfer annulus 9 has commenced. While advancing within the non-power transfer annulus, the rotor compresses the fuel/air mixture into the compression/combustion chamber 14 via the peripheral orifice 18.

Figure 6:
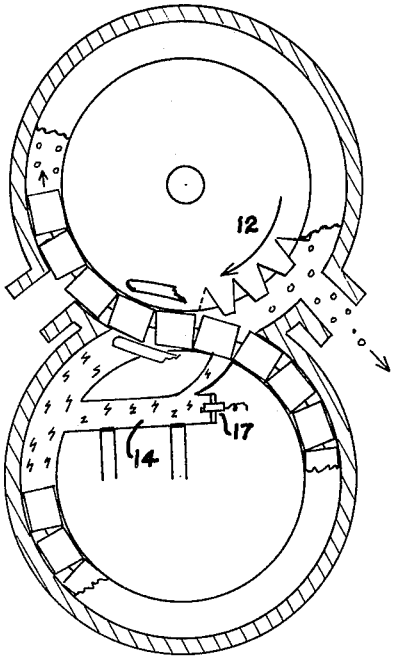

In FIG. 6 the power cycle has commenced. Ignition means 17 within the compression/combustion chamber 14 has ignited the compressed fuel/air mixture and the expansion of the ignited mixture forces the rotor through the non-power transfer annulus and into the power transfer annulus in the direction shown. In the power transfer annulus, the rotor transfers power to the rotatable, concentrically disposed power transfer means 12.

Figure 7:
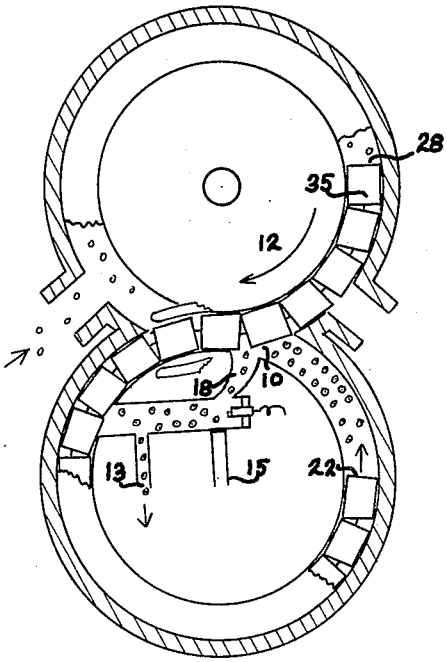

In FIG. 7 the exhaust cycle has commenced. The exit conduit means 13 is open and the inlet conduit means 15 is closed. The rotor forces the exhaust fluid out of the non-power transfer annulus via peripheral orifice 18 and the exit conduit means. The inlet conduit means 15 and the exit conduit means 13 are in cyclic communication and cooperation with the rotatable, concentrically disposed power transfer means 12. When the leading and trailing rotor segments are positioned within the common chamber 10, the leading edge 22 of the leading rotor segment and the trailing edge 28 of the last segment 35 maintain continuous, sealable contact.

While in the foregoing description and accompanying drawings there has been shown and described the preferred embodiment of this invention, it will be understood, of course, that minor changes may be made in details of construction as well as in the combination and arrangement of parts without departing from the spirit and scope of the invention as claimed.

Having thus described my invention in preferred embodiments, what I claim is:

1. A rotary engine of the internal combustion type, comprising:

a rotor housing consisting of two hollow annular chambers of the same size lying in the same plane; the circles drawn at the mid-point of each annulus being tangent to each other and non-intersecting;

said annuluses overlap to form a common chamber;

a rotor consisting of loosely coupled segments is centrally disposed within said annular chambers;

said rotor consisting of a fixed number of segments which, when positioned totally within one annulus, fully circumscribes the smaller circumference of said annulus;

said rotor being in slidable and sealable engagement with said rotor housing;

said rotor being free to rotate in a fixed direction, alternately through each annulus thereby describing a 'figure 8' path;

power transfer means are secured to said rotor via engagement of rotatable, concentrically disposed means within one annulus and extending beyond said rotor housing; said annulus being referred to as the power transfer annulus;

compression/combustion means are recessed in the inner surface of the second annulus; said annulus being referred to as the non-power transfer annulus;

said compression/combustion means is in spaced relationship with said common chamber;

intake passage means are contained within said compression/combustion means and in cyclic cooperation and communication with said non-power transfer annulus;

exhaust passage means are contained within said compression/combustion means and in cyclic cooperation and communication with said non-power transfer annulus;

said intake and exhaust passage means being in cyclic cooperation and communication to provide mutually exclusive fluid flow systems.

2. An engine according to claim 1 wherein said intake passage means is in cooperation with a fuel/air mixing source for admitting a fuel/air mixture into said compression/combustion means.

3. An engine according to claim 1 wherein said intake passage means is adapted for admitting air into said compression/combustion means and fuel injecting means are provided for admitting fuel directly into said compression/combustion means.

4. An engine according to claim 1 having a plurality of operative section means in abutting relationship secured to common power transfer means.

5. An engine according to claim 1 wherein non-combustion air exhaust passage means is provided in the power transfer annulus;

said non-combustion air exhaust means is in spaced relationship with said common chamber.

6. An engine according to claim 1 wherein non-combustion air entry passage means is provided in the power transfer annulus;

said non-combustion air entry means is in spaced relationship with said common chamber.

* * * * *